United States Patent [19]

Daniels

[11] 4,427,167

[45] Jan. 24, 1984

[54] STABILIZING APPARATUS FOR AN AIR LAUNCHED WEAPON

[75] Inventor: Peter Daniels, Fredericksburg, Va.

[73] Assignee: The United States of America as represented by the Secretary of the Navy, Washington, D.C.

[21] Appl. No.: 303,801

[22] Filed: Sep. 21, 1981

[51] Int. Cl.[3] ..... F42B 15/16

[52] U.S. Cl. ..... 244/3.24; 102/385; 102/386

[58] Field of Search ..... 244/3.1, 3.24, 3.3; 102/348, 382, 385, 386, 502, 529

[56] References Cited

U.S. PATENT DOCUMENTS 4,010,688 3/1977 Smith et al. ..... 102/483

FOREIGN PATENT DOCUMENTS 1453821 2/1969 Fed. Rep. of Germany ..... 102/529

*Primary Examiner*—Richard E. Schafer
*Assistant Examiner*—Maureen T. Ryan
*Attorney, Agent, or Firm*—R. F. Beers; A. L. Branning; W. R. Henderson

[57] ABSTRACT

Apparatus for stabilizing a weapon launched from an aircraft. The weapon is provided with a plurality of concentric rings mounted on the nose of the weapon for reducing nose lift. The tail of the weapon is provided with a plurality of wedge shaped fins positioned on a decreasing tail diameter which increases the tail stability while minimizing tail lift. The outer faces of the fins are of a multi-tiered construction with angled portions connecting the tiers.

4 Claims, 2 Drawing Figures

STABILIZING APPARATUS FOR AN AIR LAUNCHED WEAPON

BACKGROUND OF THE INVENTION

The present invention relates to apparatus for improving the separation characteristics and stability characteristics of fin stabilized weapons launched from aircraft and more particularly to the stabilization of air launched weapons by reducing the nose lift of the weapon while increasing the tail stability and minimizing the tail lift of the weapon.

Weapons launched from aircraft are fin span limited due to design restrictions introduced by multiple carriage external racks designed to hold the weapon on the aircraft. This fin span limitation can result in weapon stability problems that severely degrade the accuracy of the weapon. Weapons with limited fin span and low density also suffer from aircraft separation problems that can cause severe damage to both the aircraft and the weapon if the weapon collides with the aircraft due to the carrying back of the weapon into the aircraft after launch.

A prior method for solving these stability and separation problems has been the use of folding fins on air launched weapons. The fins are folded during storage and are activated to open upon release of the weapon from the aircraft. The disadvantage of using folding fin weapons is that fin opening times are lengthy such that in high speed aircraft the weapon experiences excessive yaw after launching and thus the weapon has degraded accuracy. Moreover, the folding fin, after deployment, can develop excessive lift which further complicates the separation problem by keeping the weapon in the aircraft's immediate flow field for a longer period of time due to reduced sink rate.

The stabilizing apparatus of the subject invention eliminates the stability and separation problems encountered by air launched weapons by reducing the nose lift of the weapon while increasing tail stability and minimizing the tail lift of the weapon.

SUMMARY OF THE INVENTION

Accordingly, there is provided in the present invention apparatus for stabilizing an air launched weapon. The weapon is stabilized by mounting a plurality of concentric rings on the nose of the weapon to reduce nose lift. A plurality of wedge shaped fins are mounted on a decreasing diameter tail to increase tail stability while minimizing tail lift of the weapon. The outer faces of the fins are of a multiple tier construction with an angled portion connecting the tiers. The multi-tiered outer face moves the fin center of pressure to the rear of the weapon.

OBJECTS OF THE INVENTION

It is an object of the present invention to eliminate the stability and separation problems of air launched weapons.

Another object of the invention is to reduce the nose lift on air launched weapons.

A further object of the present invention is to increase the tail stability and minimize the tail lift of air launched weapons.

Other objectives, advantages, and novel features of the present invention will become apparent from the following detailed description of the invention when considered in conjunction with the drawings.

BRIEF DESCRIPTION OF THE DRAWINGS

A more complete appreciation of the invention and many of the attendant advantages thereof will be readily understood by referring to the following detailed description when considered with the accompanying drawings in which like reference numerals designate like parts throughout the figures and wherein.

DESCRIPTION OF THE PREFERRED EMBODIMENT

Figure 1:
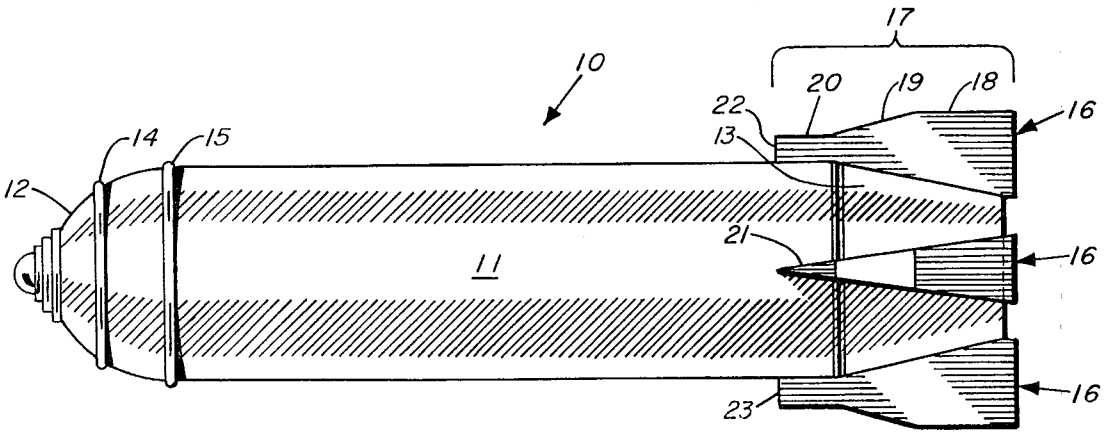
FIG. 1 shows a side view of an air launched weapon with the stabilizing apparatus of the subject invention.

Referring to FIG. 1, there is illustrated a side view of an air launched weapon 10 provided with the stabilizing apparatus of the subject invention. The air launched weapon is constructed with a body 11 having an ogive nose 12 and a decreasing diameter tail 13.

Figure 2:
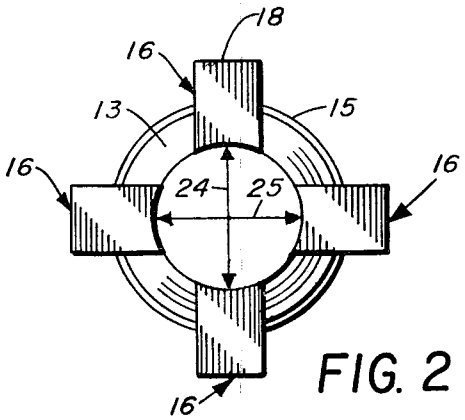
FIG. 2 shows an end view of the air launched weapon of FIG. 1.

The nose of the weapon is provided with a plurality of concentric mounted linearly spaced apart rings or spoilers, illustrated in FIGS. 1 and 2 as 14 and 15. The plurality of rings or spoilers reduce the nose lift of weapon 10 by separating the flow over the weapon nose.

As illustrated in FIG. 1 the air launched weapon is also provided with a plurality of discrete radially extending freestanding wedge shaped fins, illustrated as 16. Fins 16 are mounted on the decreasing diameter tail 13 of weapon 10. Each fin 16 is provided with a multi-tiered outer face 17 which functions to move the fin center of pressure rearward on the weapon. As illustrated in FIG. 1, the multi-tiered outer face 17 is provided with a first stepped portion 20 connected to a second stepped portion 18 by angled surface or ramp 19. The first stepped portion is located at the apex of the wedge and extends forward in the direction of nose 12. The second stepped portion is positioned to the rear of the fin so as to correspond to the opening of the wedge angle which extends rearward on the fin.

FIG. 1 illustrates that each of the wedge shaped fins can be seen as forming a wedge shape in two planes. Fin 21 is illustrated as having a wedge shape on the outer face parallel to missile diameter 24 while fins 22 and 23 can be seen as having a general wedge shape parallel to missile diameter 25. Thus, the fins of the stabilizing apparatus of air launched weapon 10 can be characterized as having a double wedge shape.

It is thus apparent that the disclosed stabilizing apparatus for an air launched weapon eliminate the separation and stability problems encountered when launching such weapons from an aircraft. The stabilizing apparatus reduces the nose lift of the weapon and increases tail stability while minimizing the tail lift of the weapon thus resulting in an air launched weapon having increased stability and accuracy.

Many obvious modifications and embodiments of the specific invention other than those set forth above will readily come to mind to one skilled in the art having the benefit of the teachings presented in the foregoing description and the accompanying drawings of the subject invention, and hence it is to be understood that such modifications are included within the scope of the appended claims.

What is claimed as new and desired to be secured by Letters Patent of the United States is:

1. Apparatus for stabilizing an air launched weapon in free flight after being dropped by an airplane which weapon includes a nose and a tail, comprising:

ring means concentrically disposed about the weapon nose defining spoiler means for reducing nose lift by separating air flow thereover; and means increasing tail stability while minimizing tail lift of the weapon comprising a plurality of radially extending freestanding wedge shaped fins, each fin having sides defining a wedge angle tapering to a wedge apex and the wedge angles opening rearward of the weapon and each wedge apex facing forward;

said fins further including first and second stepped portions defining outer faces connected by an angled ramp for moving the fin center of pressure rearward.

2. The invention according to claim 1 wherein the ring means comprises a plurality of linearly spaced apart rings concentrically disposed about the nose of the weapons and extending above the surface of the weapon defining the nose.

3. The invention according to claim 1 wherein the second stepped portions of the fins are disposed aft of and farther outward from the weapon than the first stepped portions.

4. The invention according to claim 1 wherein the wedge shaped fins are further defined as flaring from both sides thereof to define a double wedge configuration.

* * * * *